United States Patent [19]

Newton

[11] Patent Number: 4,809,154

[45] Date of Patent: Feb. 28, 1989

[54] AUTOMATED CONTROL SYSTEM FOR A MULTICOMPONENT REFRIGERATION SYSTEM

[75] Inventor: Charles L. Newton, Bethlehem, Pa.

[73] Assignee: Air Products and Chemicals, Inc., Allentown, Pa.

[21] Appl. No.: 884,122

[22] Filed: Jul. 10, 1986

[51] Int. Cl.[4] ..... G06F 15/46; F25U 1/02

[52] U.S. Cl. ..... 364/148; 62/9; 62/40; 364/172

[58] Field of Search ..... 364/468, 148, 156, 172, 364/173, 500, 502; 62/9, 36, 37, 40

[56] References Cited

U.S. PATENT DOCUMENTS

| | | | |
|---|---|---|---|
| Re. 29,914 | 2/1979 | Perret | 62/40 X |
| 3,763,658 | 10/1973 | Gaumer, Jr. et al. | 62/40 |
| 4,033,735 | 7/1977 | Swenson | 62/9 |
| 4,504,296 | 3/1985 | Newton et al. | 62/40 X |
| 4,584,006 | 4/1986 | Apffel | 62/40 X |

OTHER PUBLICATIONS

Air Products and Chemicals, Inc.-"Multi-Component Refrigerant Process Control"-pp. 50-53-Nov. 1978.

*Primary Examiner*—Joseph Ruggiero

*Attorney, Agent, or Firm*—Thomas G. Ryder; James C. Simmons; William F. Marsh

[57] ABSTRACT

An automated control system for the control of mixed refrigerant-type liquified natural gas production facilities comprising optimization of functional parameters, concurrent monitoring and adjustment of critical operational limits, and maximization of production functions. Optimization is accomplished by adjusting parameters including mixed refrigerant inventory, composition, compression ratio, and compressor turbine speeds to achieve the highest product output value for each unit of energy consumed by the facility.

18 Claims, 3 Drawing Sheets

AUTOMATED CONTROL SYSTEM FOR A MULTICOMPONENT REFRIGERATION SYSTEM

BACKGROUND OF THE INVENTION

As described in U.S. Pat. No. 3,763,658, systems for the liquification of natural gas using a multicomponent or mixed refrigerant are currently in use throughout the world. Such systems typically employ a four-component refrigerant comprising nitrogen, methane, ethane, and propane which is circulated through a multizone heat exchanger in order to cool a feed stream of natural gas to the low temperatures at which it condenses to form LNG (typically −260° F). In order to adequately cool feed streams of varying composition, temperature, and pressure, controls are required for varying the flow of refrigerant through the heat exchanger, the composition of the mixed refrigerant, the degree of compression applied to the mixed refrigerant, and other physical parameters effecting the operation of the main exchanger and refrigeration loop.

In a typical operating installation which employs a multicomponent refrigerant system, the overall facility is designed in accordance with certain design specifications which are intended to insure operation of the plant within predefined limits. On the basis of customer specifications of feed stream compositions and conditions, plant designers typically determine an optimum operating state for the system including compositions, temperatures, and pressures for the various parts of the mixed refrigerant loop. It has been found, however, that achieving and maintaining these design conditions are exceedingly difficult. Furthermore, variations in plant condition including feed stream composition variations, environmental variations, and defects such as leaks in compressor seals, valves and pipe joints all contribute to instability of the facility. For these reasons, typical mixed refrigerant plants operate at less than optimum efficiency. Because human operators are incapable of closely monitoring and adjusting for all of the variations inherent in an operating facility, and because of the many relationships which are not apparent even to highly skilled and experienced operators, overall plant efficiency is degraded, thus increasing the cost of plant product to the consumer.

Finally, when it is desirable to operate the LNG plant so as to attain maximal production, similar variability comes into play. Operation of the plant at maximum production inherently means less than optimum efficiency level is achieved. However, balancing production against efficiency requires degrees of control not presently attainable.

BRIEF DESCRIPTION OF THE INVENTION

The present invention comprises an automated control system for a liquified natural gas plant of the mixed or multicomponent refrigerant type. A process controller system includes a plurality of sensors for detecting various conditions in the plant such as temperature, pressure, flow, or composition, a plurality of controllers such as servo-controlled valves, and a computer executing the control program.

The controller system, in response to a desired production rate specified by an operator, will either so control the plant as to provide the desired production rate with the highest possible efficiency, or will maximize the production of the plant with the highest attainable efficiency level consistent with the maximized production level. Furthermore, the controller system of the present invention responds to changes in condition of the plant automatically, including changes in feed stream composition, pressure, temperature and changes in ambient conditions. Optimization of production efficiency is carried out by adjusting mixed refrigerant liquid inventory, composition, compression ratio, and compressor turbine speeds.

DETAILED DESCRIPTION OF THE INVENTION

MR LNG Plant

Figure 1:
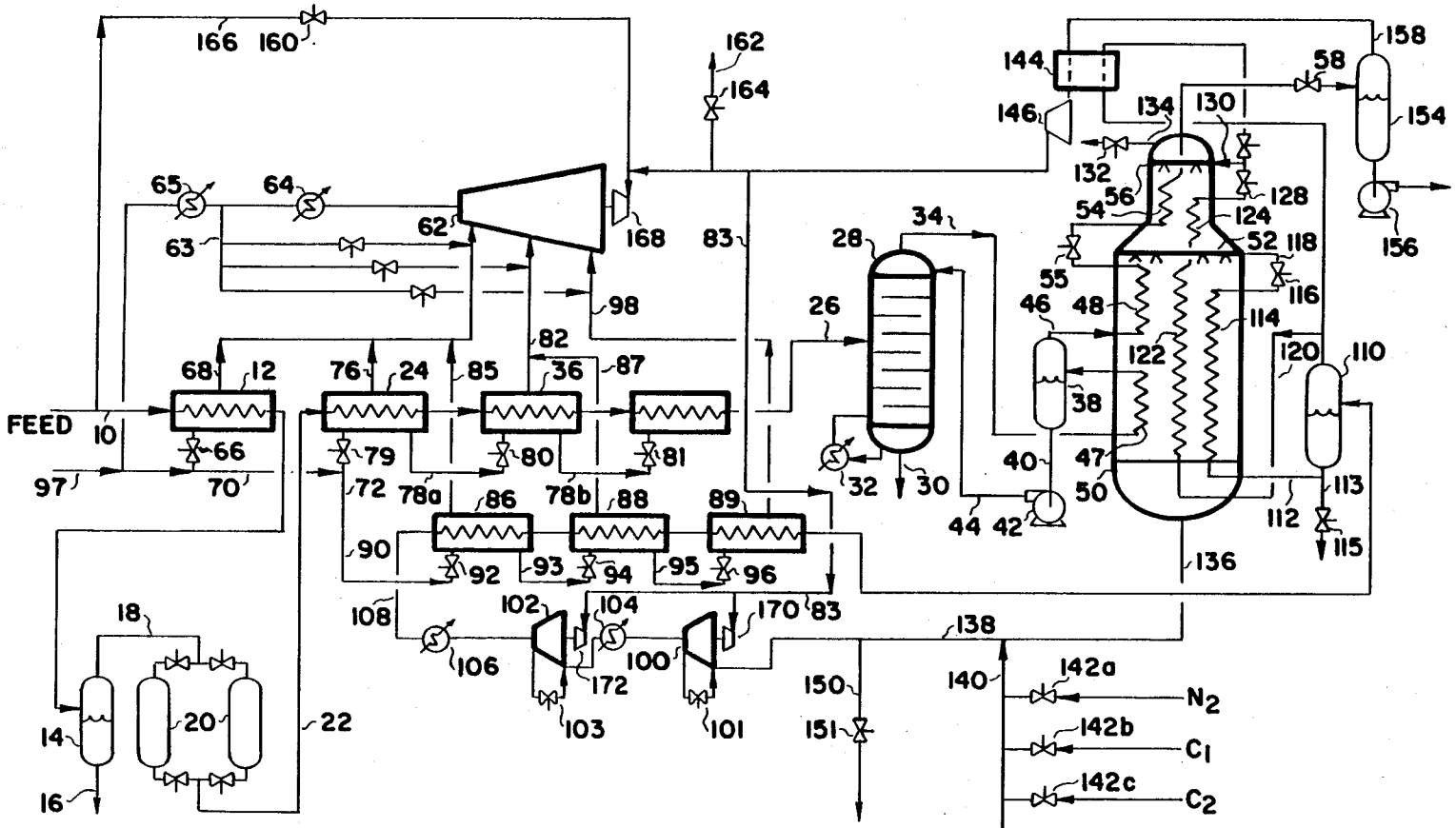
FIG. 1 is a schematic flow diagram of a typical mixed refrigerant liquified natural gas plant controlled according to the present invention.

Referring now to FIG. 1, there is shown a schematic flow diagram of MR LNG plant 2 which is typical of a plant controlled according to the present invention, and the operation of plant 2 is described in U.S. Pat. No. 3,763,658. Insofar as possible, reference numerals used in FIG. 1 correspond to those employed in the figure of U.S. Pat. No. 3,763,658. For the purposes of the present invention, it is not necessary to reiterate the description of plant functionality of U.S. Pat. No. 3,763,658. Differences between the plant described in U.S. Pat. No. 3,763,658 patent and the one shown in FIG. 1 include the use of three stages of mixed refrigerant heat exchange in the evaporators 86, 88 and 89, the use of four stages of feed heat exchange, the use of a three-stage propane compressor 62, and depiction of a fuel system comprising fuel header makeup line 166, control valve 160, MR compressor fuel feed stream 83, fuel header vent line 162, fuel header vent valve 164, MR flash recovery exchanger 144, LNG flash/fuel compressor 146, LNG flash separator 154, LNG flash vapor line 158, and LNG JT valve 58. MR makeup system 140 includes valves 142a,b,c,d which control the admission of makeup gases to the MR loop. Further description of individual system components will be given as the Detailed Description of the preferred embodiment of the controller warrants.

Figure 3:
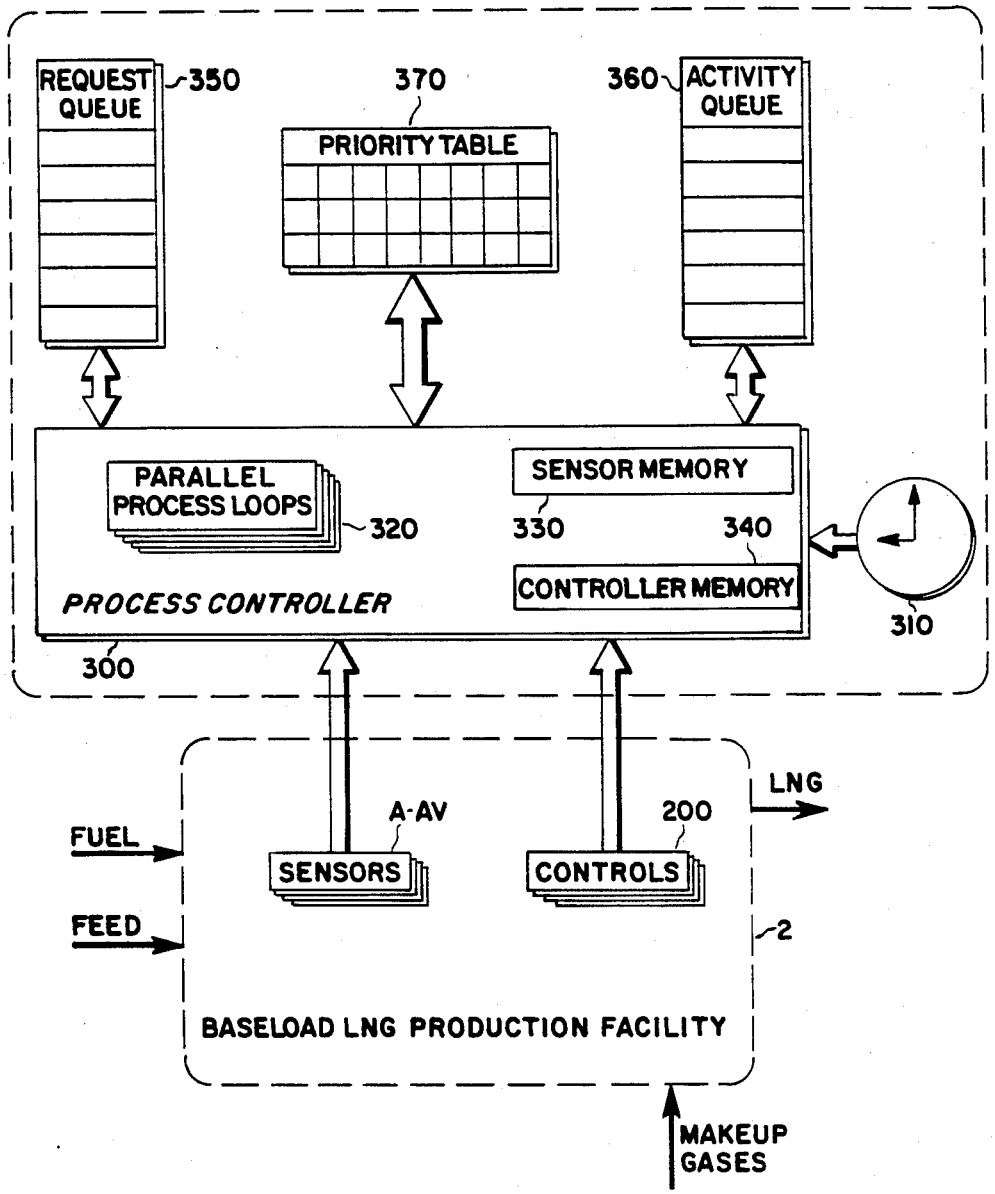
FIG. 3 is a block diagram of the process controller system of FIG. 1.

Referring now to FIG. 3, there is shown a block diagram of process controller system 310 of the present invention. LNG production plant 2 is depicted as a region surrounded by a phantom line having inlets for fuel, feed and makeup gases and an outlet for liquified natural gas. Within LNG production facility 2 are located a plurality of sensors A-AV and a plurality of controls 200 such as servo-controlled valves such as for controller valve 116. Only valves indicated by an asterisk (*) in control column of Table 1 are so controlled; others may be controlled according to prior art manual or automatic controller techniques. Sensors A through AV and controls 200 communicate with process controller 300 through conventional electronic communication means.

Process controller 300 comprises sensor memory 330 having individual memory locations corresponding to individual sensors A through AV, controller memory 340 having individual memory locations corresponding to each of controls 200, and a plurality of parallel process loops 320. In addition, process controller 300 maintains request queue 350 which is a queue of process service requests, and return queue 360. Process controller 300 also maintains priority table 370 which is used in order to resolve contention among operating process loops 320. Priorities for table 370 are listed in Table 2. Finally, process controller 300 has access to real time clock 310 for measuring intervals and controlling other time sensitive functions.

In order to control the 17 servo-controls associated with LNG production facility 2 in accordance with correlated readings which emanate from separate sensors A-AV associated with discrete conditions within LNG production facility 2, the process controller system is implemented in a parallel processing computer system. Among the tasks which are carried out in parallel are low level monitoring and controller functions, system executive management functions, limit and alarm functions necessary to the safe operation of the production plant, and ongoing adjustment functions which provide increases in efficiency independent of the operating state of the production facility.

The use of parallel processing allows ongoing monitoring and control of the production plant without regard to the need to define extensive interrupt service prioritization such as is typically found in a sequential controller system. While such contention may in fact arise, the system of the present invention may quickly resolve that contention while not interrupting ongoing control processes or other computational activities. The following is a description of the preferred embodiment for the system executive control functions and control architecture of the present invention.

Processor controller system 310 allows parallel control processes to be executed on multiple processors having access to a common storage 330 and 340. Within this common storage are stored values representative of the current state of every sensor and every controller associated with production facility 2. In addition, various indicators or flag fields are defined for management of the controller system. An active control status indicator is an area of the commonly accessible storage means having one flag significant of each parallel process loop. Upon entry to any loop, the system executive will set the corresponding flag in the active control status indicator. Upon exit from a loop, the system executive clears or resets the corresponding flag. By this mechanism, all parallel processes within the system may determine which processes are currently active and in this way avoid contention or conflict.

The System Executive (Appendix, page 1) also maintains a request queue 350 and a return queue 360 for management of high priority requests. The function of these queues is best described with reference to an example situation within the system:

Assuming that the system is operating at an optimum steady-state condition and is achieving a specified target production rate, it is conceivable that a compressor (e.g., 100, 102, 62) might, for any of a variety of reasons, approach a surge condition. Should this condition occur, the parallel Antisurge Control routine (Appendix, page 6) would detect it. Upon being detected, the Antisurge Control process would request active status from the System Executive in order to permit it to preempt the actions of all other controllers while it resolves the surge condition.

Upon receiving the activity request from the Antisurge Controller, the System Executive would apply its Resolve Contention routine (Appendix, page 2) in order to determine whether active status should be granted to the Antisurge Control routine. The priority of the currently active routine would be compared to the priority assigned to the requesting routine and, assuming the requesting routine has a higher priority level as defined in priority table 370, the loop identification and a reassert timer for the current process would be placed on the System Executive return queue 360. The System Executive would then clear the activity status flag of the currently executing loop, set the activity status flag of the Antisurge Control routine, set a flag indicative of the presence of a record in the return queue, and transfer control to the Antisurge Control routine. Upon normal exit of the Antisurge Control routine, the System Executive, recognizing its return queue flag, would reactivate the routine which had been executing prior to the occurrence of the surge condition. Alternatively, if the Executive has not reactivated the original process after a specified period of time, the Queue Manager (Appendix, page 2) acts to reassert a request that the process become active again. This reassertion is handled by the Resolve Contention process within the System Executive which will either allow reactivation, or will again defer the process by placing it on the request queue.

In cases where a routine requesting active status is of a lower priority than that which is currently executing, the identification of that requesting process is placed on a request queue along with a reassertion timer. The request queue 350 also has a corresponding flag within the System Executive. Should a process terminate, the System Executive will verify the status of those routines which have been placed within the system request queue and will attempt to execute these by reasserting the request through the Resolve Contention process. In this way, the process controller of the present invention is assured that it will spend no idle time unless there is only a single routine executing and no other processes are requesting service.

With a sufficiently fast processor, the architecture described above may be approximated by a sequential process. As will be evident to those skilled in the art, such a sequential process must be event or interrupt driven and the time necessary to execute the major control loop must be short enough so as not to unduly damp the response of controller 300.

The following discussion will be made with reference to FIGS. 1 and 2 as well as the pseudocode listing of the Appendix. It will be appreciated by those skilled in the art that, in a system comprising at least 17 controls (i.e., values) operating in accordance with at least 43 sensors, the degree of variability in selecting precise locations, sensors, and operating parameters is extremely large. It is intended that the following description be taken only as a preferred embodiment.

Figure 2:
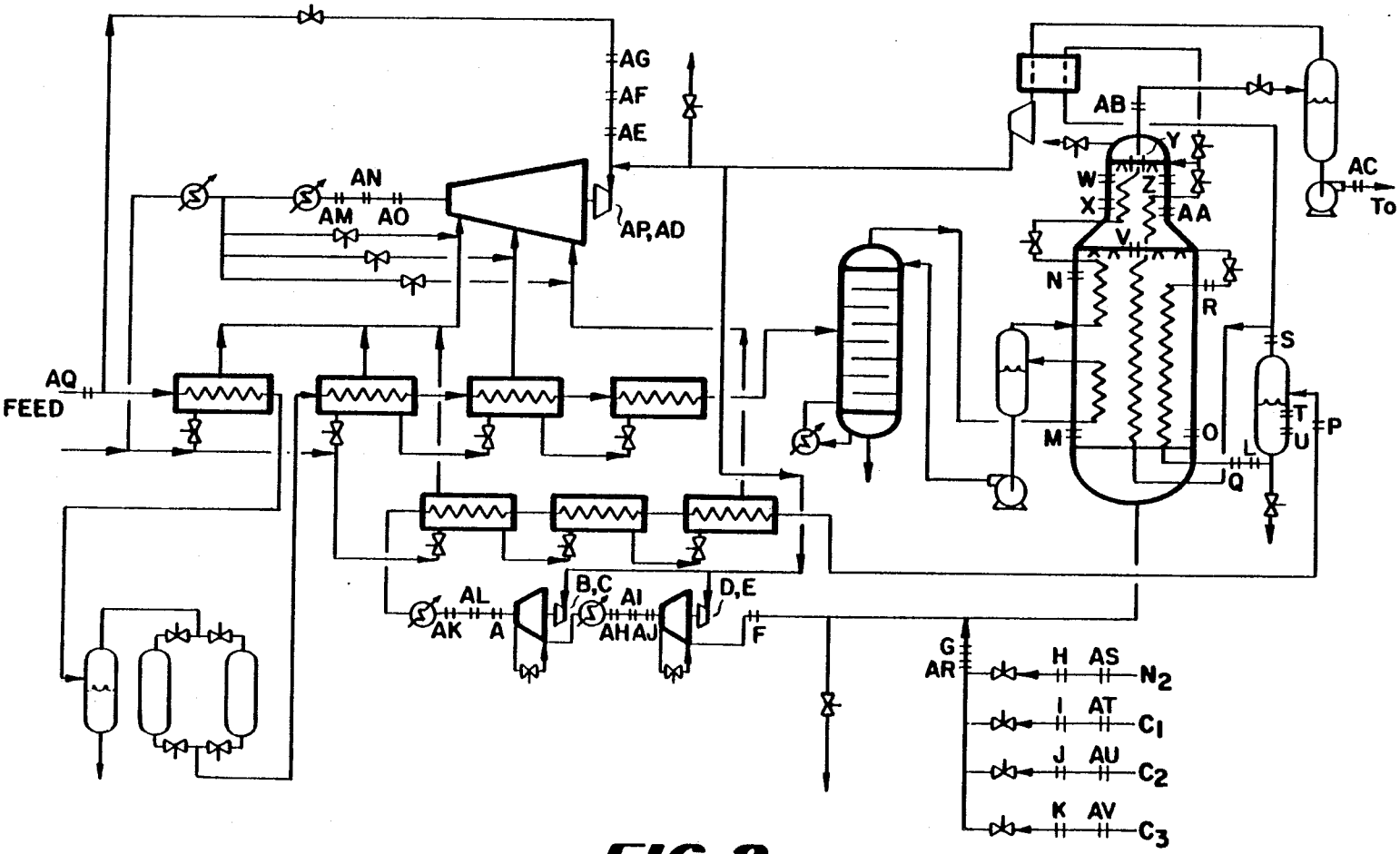
FIG. 2 is a schematic flow diagram of the plant of FIG. 1 indicating the placement of sensors for indicating plant operating parameters to the process controller system.

Referring now to Table 1, there is shown a cross-reference table indicating the component descriptions of the major components depicted in FIGS. 1 and 2, the locations of various sensors within production system 2, and the variables represented by both sensors and controllers which are used in the control program shown in pseudocode listing Appendix.

Referring now to the pseudocode listing, there is shown a listing of routine System Executive. The System Executive routine comprises a parallel processing loop for executing System Executive management functions, low level alarm operation functions, ongoing monitoring functions, and controller functions. These functions are depicted as operating procedures which execute in parallel. This architecture is one in which each executing process may occupy its own unique processor in the parallel processing system. It will be understood that parallel processes may be executed on one or a plurality of processors. Division of labor will necessarily depend upon the availability of processors for a particular implementation.

The Monitor Operating Parameters routine actually executes as 43 concurrent processes, each associated with a particular sensor within system 2. Each parallel routine is a programmatic loop which fetches the sensor value and places that value in a predefined memory location. It will be understood that such a routine may also include filtering and scaling steps unique to a particular sensor or group of sensors. For instance, where a sensor is subject to high levels of noise, band-pass filtering or time weighted integration may be applied in order to reduce the noise level. Alternatively, raw sensor data may be placed in memory where it is subsequently processed for noise filtering, scaling, or other such requirements.

The Set Controllers routine similarly comprises 17 parallel routines, each corresponding to a given controller within system 2. The Set Controllers routine may also employ signal processing techniques for adjusting for variances in gain, response time, and providing damping of controllers.

Routines Resolve Contention and Queue Manager have been described above in connection with the overall system architecture. The Resolve Contention routine references priority table 370. Example values contained in priority table 370 are included in Table 2. These priority values may change based upon a particular system configuration and are intended as an example of the contention resolution function.

Routine Monitor Production is the main routine which operates in parallel with the lower level alarm, monitor and controller functions to allow optimization of the production system. It is the Monitor Production routine which determines the current production rate of the entire system and calls subsidiary routines in accordance with the variance of that rate from the desired or target production. It is anticipated that the largest percentage of the time, Monitor Production routine will call the Optimize routine. However, when actual production either falls below or rises above the operator specified target production, then routines Turn Down Production or Turn Up Production are called.

Assuming that monitored current production of system 2 is equal to the target production specified by the operator, routine Optimize will be executed. Routine Optimize begins by ascertaining whether the correct inventory level of MR liquid is present in high pressure MR separator 110. The correct level of MR liquid is specified as being below the level of level sensor T and above the level of level sensor U. Should the MR liquid inventory be found to be below the lower limit, then routine MR Liquid Level Makeup Composition and Flow will be executed. This routine will be described below. In the event that the MR liquid level is above the upper bound, MR liquid drain valve 115 is opened in order to drain high pressure separator 110. Drain valve 115 is left open until the level within high pressure separator 110 falls below that of sensor U.

After it is ascertained that the MR liquid level is within the specified range, the MR composition is then optimized. The roughest optimization of MR composition involves adjustment of flow ratio controller (FRC) valve 116. Such an optimization is carried out with regard to the overall efficiency of production facility 2.

Pseudocode Function Efficiency is used in the calculation of overall system operational efficiency. This calculation involves the total energy consumed by the system and the economic value of the liquified natural gas produced. For example, for a given fuel flow, at a particular fuel composition, a fuel heating value is obtained. Such a heating value is typically obtained through a two-step process involving chromatographic analysis of the fuel in order to determine its composition and a multiplication process of each fuel component by its heating value. The heating value is typically obtained from tables published by the Gas Processing and Suppliers Association for each hydrocarbon component of a typical gas stream. By multiplying fuel heating value by flow, a total energy consumption for the system is available.

The calculated energy consumption is then divided by the value of liquified natural gas produced using the energy. As an example, if LNG is sold by the cubic foot, the value of each cubic foot would be divided into the energy consumed for its production in order to give an instantaneous efficiency figure expressed in terms of energy per dollar profit. This instantaneous efficiency may be stored and compared to later readings of efficiency in order to provide a comparison for a particular optimization of adjustment.

In the case of optimization of MR composition, the setting of the flow ratio controller valve 116, nitrogen content of the MR, and $C_3$:$C_2$ ratio is done sequentially by an algorithm which attempts to find peak efficiency while adjusting the given parameter.

While these adjustments (FRC, $N_2$, $C_2$:$C_3$ ratio) may have some effect upon each other, and thus may be performed in other orders than shown, the preferred embodiment adjusts them in the order described above.

After optimization of these parameters, the compression ratio controller (CRC) valve 128 is adjusted for peak efficiency. In such an adjustment, the compression ratio is incremented by a percentage which is determined by experience. This percentage would be initially input from the design specifications for the facility but would subsequently be adjusted within the controller program itself to provide an optimum step value. The optimization of compression ratio begins by incrementing the compression ratio until a peak efficiency is reached or until the MR compressor discharge pressure exceeds a predefined maximum pressure. When either of these conditions is met, the compression ratio is decremented until the efficiency falls. After finding maximum efficiency versus compression ratio, the last optimization step performed is an optimization of compressor turbine speed.

Since it is desirable to operate a gas turbine 170,172 at 100% of its design speed, the optimization begins by ascertaining whether current speed is maximal (with regard to design ratings). If current speed is not maximal, the speed is incremented until an optimum efficiency is found or maximum speed is achieved. If maximum speed is already met, then the speed is decremented until maximum efficiency is achieved.

Once optimization is complete, the Monitor Production routine is again iterated. In most instances, optimization will have increased production so that it will be possible to decrease production to the predetermined target level, thus conserving input energy. This permits the facility to run at maximum efficiency while maintaining a predetermined level of production.

Routine Turn Down Production (Appendix, page 4) is called when the Monitor Production routine determines that measured production of the system exceeds the operator input target production. The Turn Down Production routine first determines whether the measured production is within 4% of desired target production. If measured production falls within this range, then the routine branches to the Turn Down Fine label for a fine adjustment of the production rate. If measured production exceeds target production plus 4%, execution at label Turn Down Gross first ascertains the MR compressor suction pressure and stores this value in memory. If it is determined that the MR compressor suction pressure is less than the minimum allowable pressure plus 4%, then no adjustment is made and operation returns to the Monitor Production routine. If, however, the MR compressor suction pressure is above this threshold, then MR compressor suction vent 151 is opened to allow the MR compressor suction pressure to fall by 4%.

After a gross adjustment of the MR compressor suction pressure, the Optimize routine is called in order to re-optimize the system and then the main routine Monitor Production is again called.

It should be noted that the percentages used in the various adjustment routines and tests are given as examples and are indications of the values used in the manual operation of similar facilities. It will be understood that such values vary according to the precise design of the plant being controlled, feed composition, ambient conditions, and degree of experience in plant operations. It is anticipated that these values, along with others specifying incremental adjustments and time delays, would be adjusted at plant start-up to design-specified values, but would later be readjusted or "tuned" in order to better optimize the overall efficiency of the facility.

In the case where a fine downward adjustment of production is required, the compressor suction pressure is reduced by opening of MR compressor suction vent 151. This reduction is accomplished according to a ratio including the difference between measured production and target production. In this way, a gradual intercept to target production can be made without upsetting the plant. After this fine adjustment of MR compressor suction pressure, the system is re-optimized and the main loop is re-executed.

When it is determined that measured production is below the desired target production, the routine Turn Up Production (Appendix, page 5) is called by the Monitor Production routine. In a manner similar to that employed by the Turn Down Production routine, the Turn Up Production routine first determines whether measured production exceeds target production minus 4%. If measured production falls below this level, execution continues at label Turn Up Gross.

After first ascertaining that the cold end $\Delta T$ is not below the minimum permitted value, a predetermined amount of nitrogen is injected by opening valve 142*a*. The routine then waits for a predetermined amount of time and repeats the process until the cold end $\Delta T$ falls outside the acceptable limits. Once it is determined that the cold end $\Delta T$ is sufficiently large, then a target MR compressor suction pressure is calculated as the current pressure plus 4%. The C Inject routine is then executed, followed by the monitor production main loop.

When it is determined that a fine upward adjustment of production is required, the routine Turn Up Fine is called. Turn Up Fine first optimizes the system and then ascertains whether measured production is still below target production. If measured production remains below target production, then a new target MR compressor suction pressure is calculated as a ratio between the target and measured productions and the C Inject routine is called.

Referring now to the routine MR Liquid Level Makeup Composition and Flow (Appendix, page 6), which is called by the Optimize routine when it is determined that mixed refrigerant liquid inventory is low, there is shown a preferred embodiment for the liquid level makeup function. Upon being called, the routine begins by storing in memory the initial makeup inlet valve positions. These valves are positioned by other routines in order to compensate for leakages in the facility. At steady state operation, each valve's flow rate will precisely balance the leakage of its particular component from the system. The routine then proceeds to a loop in which it ascertains the molar composition of each of the components of the mixed refrigerant. The inventory to be made up is then calculated. This inventory makeup rate includes an estimated time during which the inventory should be brought to within acceptable limits. A timer is reset and started and the makeup valves 142*a,b,c,d* are proportionally opened to a degree represented by the product of the molar fraction of the particular component being injected and the overall makeup rate which is calculated. Once the four makeup inlet valves have been opened, the MR makeup flow is ascertained and the time estimate used for calculating flow rate is decreased by the amount of elapsed time. A new makeup flow rate is then calculated.

If it is determined that the measured makeup flow is less than the new makeup flow, the time estimate is decremented by a predetermined amount and a new makeup flow rate is calculated in order to increase makeup rate. If it is determined that the total flow rate required by the new makeup rate divided by the remaining time is greater than the maximum flow rate achievable, then an operator alarm is sounded and the controller loop is aborted. The abort procedure discontinues the parallel processing loop and begins the sequential procedure abort within the System Executive. At the conclusion of the makeup loop, the initial makeup inlet valve positions are restored in order to again balance leakage from the system.

The C Inject routine (Appendix, page 8) is called by the Turn Up Production routine. It begins by opening the $C_1$ injection valve 142*b*. A series of tests are then performed for certain physical limits of the system. The compressor discharge pressure is measured in order to assure that it remains below a design maximum, and the warm and cold end upset $\Delta$ Ps are measured to ascertain that the remain within design limits. Finally, the turbine firing temperatures are measured. If all of these critical parameters are within design specification limits, the MR compressor suction pressure is measured. When this pressure reaches the target compressor suction pressure, then $C_1$ injection valve 142*b* is closed and the Optimize routine is called. If any of the design specifications are exceeded, the $C_1$ injection valve 142*b* is closed immediately and, if the flag OPT is set, the production target is reset downward. If the flag OPT is not set, then the Optimize routine is called after setting OPT.

The ongoing Fuel Balance routine (Appendix, page 11) maintains the fuel header pressure at the fuel header pressure midpoint. The routine calculates the distance from the pressure midpoint by means of distance algorithms employing the fuel inlet pressure as well as the design maximum, midpoint and minimum pressures for the fuel header. In the event that the fuel header pressure is above the midpoint pressure vent valve 164 is opened proportionally in order to reduce the fuel header pressure. In addition, temperature controller 58 is reset to a lower temperature by a predetermined percentage in order to reduce the amount of fuel derived from a flash in receiver 154. In the event that the fuel header pressure is below the midpoint, fuel feed makeup valve 160 is opened by a predetermined amount and temperature controller 58 is reset higher by a predetermined percentage in order to produce more flash in receiver 154.

Referring now to the Antisurge Controller routine, there is shown a pseudocode representation of a compensated flow-based antisurge controller. An example of the type of controller herein described may be found in U.S. patent application Ser. No. 521,213, abandoned in favor of FWC 067,408, assigned to the assignee of the present invention. As described therein, flow at the compressor outlet is temperature compensated and a distance to the compressor design surge line is calculated. Should the calculated distance to surge fall within a predetermined range of the surge line, a flow recycle valve is automatically opened to direct flow from the compressor outlet to the compressor suction. When it is determined that the distance to the surge line has again increased, the recycle valve is then closed.

The Compressor Turbine Overspeed Control routine (Appendix page 7) is a concurrently operating process which continually compares compressor turbine speed to the design maximum speed for the machine. Should turbine speed exceed design maximum, an alarm will be set and speed will immediately be reduced to, for example, 105% of design.

In a similar manner, the Compressor Turbine Overtemperature Control (Appendix, page 7) continuously monitors compressor turbine firing temperature and compares that temperature to the design maximum temperature. Should turbine temperature exceed the design maximum, the turbine overtemperature alarm is set and the fuel being fed to the turbine is reduced by a predetermined percentage in order to reduce the firing temperature.

During the operation of the Antisurge Control routine, Turbine Overspeed Control routine and Turbine Overtemperature Control routine, the prioritization effected by the System Executive routine effectively prevents other controller functions from interfering with adjustments being made in order to alleviate the emergency condition.

Other critical parameters of the liquified natural gas production facility are monitored by the routines Sense Feed Pressure, Monitor $\Delta T_C$, Monitor $\Delta T_W$, and Monitor Makeup Supply Pressures. In each of these cases, should the system parameter being monitored fall below or exceed a design specification, an alarm is set in order to notify the system operator and the Abort procedure is executed. The Abort procedure (Appendix, page 1) is a part of the System Executive which discontinues parallel processing.

When the Abort procedure is initiated, the automatic controller is taken off-line to prevent it from continuing to operate the system and manual control from the operator is accepted. In an effort to continue to assist the operator, several parallel processes are restarted once manual control has begun. These processes include Monitor Operating Parameters, Antisurge Control, Turbine Overspeed and Overtemperature Control, and Fuel Balance. These routines continue to operate until the human operator of the system has resolved the emergency situation causing the abort and manually restarts the process control system, which then reinitializes the system and recommences the parallel processing loop of the System Executive.

The preferred embodiment of the present invention is programmed to operate in a parallel processing computer system. One such system comprises a plurality of IMS T414 transputers from Inmos Corporation. Other alternative embodiments include various parallel processing systems and architectures including, for example, Hypercube computers such as those produced by Ametek, Inc.

Alternatively, a sufficiently fast sequential processor may be programmed to provide interrupt or event driven service to time critical routines. In such a case, a dedicated interrupt priority controller would be used in order to assure interrupt service to those critical routines. As an example of a potential architecture of such a sequential implementation, a main loop which performs the functions of the routines Monitor Operating Parameters, Set Controllers, Monitor Production, Fuel Balance, and the other routines executed in parallel according to the pseudocode listing could be programmed.

A possible implementation for the interrupt controller includes the provision of seven levels of interrupt priority as follows: Antisurge Control, Compressor Turbine Overspeed Control, Compressor Turbine Overtemperature Control, Sense Feed Pressure, Monitor $\Delta T_C$, Monitor $\Delta T_W$, Monitor Makeup Supply Pressure.

System 2 uses two analyzers for providing on-stream analysis of the mixed refrigerant composition and the fuel composition. For the purpose of analyzing mixed refrigerant composition, a typical analyzer is a Bendix Chromatograph Model 002-833 fitted with a flame ionization detector. Typical MR compositions are:

| | |
|---|---|
| $N_2$ | .2–10 mol % |
| $C_1$ | 25–60 |
| $C_2$ | 15–60 |
| $C_3$ | 2–20 |

For the purpose of analyzing fuel, which comprises both product flash and natural gas from the feed, a Bendix Chromatograph using a thermal conductivity cell would typically be employed. Typical compositions for a natural gas feed are as follows:

| | |
|---|---|
| $N_2$ | .1–10 mol % |
| $C_1$ | 65–99.9 |
| $C_2$ | 0.05–22 |
| $C_3$ | 0.03–12 |
| $C_4$ | 0.01–2.5 |
| $C_5$ | 0.005–1 |
| $C_6$ | 0.002–0.5 |
| $C_{7+}$ | 0–0.2 |

For each of the components of the fuel, a heating value is calculated according to the values published in the *Gas Processors Suppliers Association Engineering Data Book* (Section 16). This table lists both net heating value and gross heating value. Gross heating value is defined as net heating value plus the latent heat of water and is the value used in calculating the overall heating value for a particular fuel composition. Fuel heating value is defined as the heating value of a particular component of the fuel times the molar fraction of that component in the fuel. The sum of these products constitutes the fuel heating value.

While this invention has been described with reference to particular and preferred embodiments, it should be understood that it is not limited thereto and that the appended claims are intended to be construed to encompass variations and modifications of these embodiments, as well as other embodiments, which may be made by those skilled in the art by the adoption of the present invention in its true spirit and scope.

Statement of Industrial Utility

The present invention is applicable to the control of mixed refrigerant-type liquified natural gas production facilities in order to provide more efficient operation of those facilities.

TABLE 1

| # | Description | Ctrl? | Sensor | Type | Variables |
|---|---|---|---|---|---|
| 2 | MCR Baseload LNG Production System | | AC | Flow | P(M) |
| 10 | Feed Stream | | AQ | Pres. | P(Feed) |
| 12 | Feed 1st Stage Heat Exchanger | | | | |
| 14 | Feed Predrier Separator | | | | |
| 16 | Feed Predrier Separator Liquid Stream | | | | |
| 18 | Feed Predrier Separator Vapor Stream | | | | |
| 20 | Driers | | | | |
| 22 | Drier Outflow Stream | | | | |
| 24 | Feed 2nd Stage Heat Exchanger | | | | |
| 26 | Scrub Column Feed Stream | | | | |
| 28 | Scrub Column | | | | |
| 30 | Scrub Column Bottoms Stream to Fractionation System | | | | |
| 32 | Scrub Column Reboiler | | | | |
| 34 | Scrub Column Overhead Stream | | | | |
| 36 | Feed 3rd Stage Heat Exchanger | | | | |
| 38 | Scrub Column Reflux Separator | | | | |
| 40 | Scrub Column Reflux Separator Bottoms Stream | | L | Anal. | Mol % $N_2$, $C_1$, $C_2$, $C_3$ |
| 42 | Scrub Column Reflux Pump | | | | |
| 44 | Scrub Column Reflux Stream | | | | |
| 46 | Scrub Column Reflux Separator Vapor Stream | | | | |
| 47 | Main Exchanger Warm Feed Tube Circuit | | | | |
| 48 | Main Exchanger Middle Feed Tube Circuit | | | | |
| 50 | Main Exchanger | | M | Pres. | ΔP(W) |
| | | | N | Pres. | ΔP(W) |
| | | | O | Temp. | ΔT(W) |
| | | | P | Temp. | ΔT(W) |
| | | | W | Pres. | ΔP(C) |
| | | | X | Pres. | ΔP(C) |
| | | | Z | Temp. | ΔT(C) |
| | | | AA | Temp. | ΔT(C) |
| 52 | Warm End Spray Header | | V | Level | WS(Lev) |
| 54 | Main Exchanger Cold Feed Tube Circuit | | | | |
| 55 | Feed JT Valve | | | | |
| 56 | Cold End Spray Header | | Y | Level | CS(Lev) |
| 58 | LNG JT Valve - TIC | * | AB | Temp. | T(P) |
| 62 | Propane Compressor | | | | |
| 63 | Propane Compressor Anti-Surge Control System | | AM | Flow | PC ASC |
| | | | AN | Pres. | PC ASC |
| | | | AO | Temp. | PC ASC |
| 64 | Propane Desuperheater | | | | |
| 65 | Propane Condenser | | | | |
| 66 | High Level Propane JT Valve | | | | |
| 68 | High Level Propane Vapor Return | | | | |
| 70 | Propane Condensate | | | | |
| 72 | Propane Condensate | | | | |
| 76 | High Level Propane Vapor Return | | | | |
| 78a | High Level Propane | | | | |
| 78b | Medium Level Propane | | | | |
| 79 | High Level Propane JT Valve | | | | |
| 80 | Medium Level Propane JT Valve | | | | |
| 81 | Low Level Propane JT Valve | | | | |
| 82 | Medium Level Propane Vapor Return | | | | |
| 83 | MR Compressor Fuel Feed Stream | | | | |
| 85 | High Level Propane Vapor Return | | | | |
| 86 | High Level Propane Evaporator | | | | |
| 87 | Medium Level Propane Vapor Return | | | | |
| 88 | Medium Level Propane Evaporator | | | | |
| 89 | Low Level Propane Evaporator | | | | |
| 90 | Propane Condensate to High Level Propane Evaporator | | | | |
| 92 | Propane Condensate JT Valve | | | | |
| 93 | High Level Propane | | | | |
| 94 | High Level Propane JT Valve | | | | |
| 95 | Medium Level Propane | | | | |

TABLE 1-continued

| # | Description | Ctrl? | Sensor | Type | Variables |
|---|---|---|---|---|---|
| 96 | Medium Level Propane JT Valve | | | | |
| 97 | Propane Coolant Makeup Stream | | | | |
| 98 | Low Level Propane Vapor Return | | | | |
| 100 | 1st Stage MR Compressor | | | | |
| 101 | 1st Stage MR Compressor Anti-Surge Control System | * | AH | Flow | 1° MRC ASC |
| | | | AI | Pres. | 1° MRC ASC |
| | | | AJ | Temp. | 1° MRC ASC |
| 102 | 2nd Stage MR Compressor | | | | |
| 103 | 2nd Stage MR Compressor Anti-Surge Control System | * | A | Pres. | P(DM), 2° MRC ASC |
| | | | AK | Flow | 2° MRC ASC |
| | | | AL | Temp. | 2° MRC ASC |
| 104 | MR Intercooler | | | | |
| 106 | MR Aftercooler | | | | |
| 108 | MR Compressor Outlet Stream | | | | |
| 110 | High Pressure MR Phase Separator | | S | Flow | FRC |
| | | | T | Level | HPSep(Lev) |
| | | | U | Level | HPSep(Lev) |
| 112 | High Pressure MR Phase Separator Liquid Stream | | Q | Flow | FRC |
| 113 | High Pressure MR Phase Separator Liquid Drain Stream | | | | |
| 114 | Main Exchanger MR Liquid Warm Tube Circuit | | | | |
| 115 | MR Liquid Drain Valve | * | | | |
| 116 | Mr Liquid JT Valve - FRC | * | R | Temp. | T(WS) |
| 118 | Warm End Spray Header MR Liquid Stream | | | | |
| 120 | High Pressure MR Phase Separator Vapor Stream | | | | |
| 122 | Main Exchanger MR Vapor Warm Tube Circuit | | | | |
| 124 | Main Exchanger MR Vapor Cold Tube Circuit | | | | |
| 128 | MR Vapor JT Valve - CRC | * | | | |
| 130 | Cold End Spray Header MR Vapor Stream | | | | |
| 132 | Main Exchanger Cold-End Shell-Side Vent Valve | * | | | |
| 134 | Main Exchanger Cold-End Shell-Side Vent Stream | | | | |
| 136 | LP Return to Main Compressor | | | | |
| 138 | MR Compressor Feed Stream | | F | Pres. | P(SC) |
| 140 | MR Makeup Stream | | G | Flow | F(MR) |
| | | | AR | Pres. | P(MR) |
| 142a | N2 Makeup Valve | * | H | Flow | $F(N_2)$ |
| | | | AS | Pres. | $P(N_2)$ |
| 142b | C1 Makeup Valve | * | I | Flow | $F(C_1)$ |
| | | | AT | Pres. | $P(C_1)$ |
| 142c | C2 Makeup Valve | * | J | Flow | $F(C_2)$ |
| | | | AU | Pres. | $P(C_2)$ |
| 142d | C3 Makeup Valve | * | K | Flow | $F(C_3)$ |
| | | | AV | Pres. | $P(C_3)$ |
| 144 | MR Flash Recovery Exchanger | | | | |
| 146 | LNG Flash/Fuel Compressor | * | | | |
| 150 | LP MR Vent | | | | |
| 151 | LP MR Vent Valve | * | | | |
| 154 | LNG Flash Separator | | | | |
| 156 | LNG Pump | | | | |
| 158 | LNG Flash Vapor | | | | |
| 160 | Feed to Fuel Control Valve | * | | | |
| 162 | Fuel Header Vent Stream | | | | |
| 164 | Fuel Header Vent Valve | * | | | |
| 166 | Fuel Header Makeup from Feed | | AE | Anal. | HV |
| | | | AF | Flow | F(l) |
| | | | AG | Pres. | |
| | | | | P(f) | |
| 168 | Propane Compressor Turbine Drive | | AP | Temp. | T(tp) |
| | | | AD | Speed | S(Mp) |
| 170 | 1st Stage MR Compressor Turbine Drive | * | D | Speed | S(M1) |
| | | | E | Temp. | T(t1) |
| 172 | 2nd Stage MR Compressor Turbine Drive | * | B | Speed | S(M2) |
| | | | C | Temp. | T(t2) |

TABLE 2

| Routine Name | Priority |
|---|---|
| System Executive: | |
| Monitor Operating Parameters | |
| Set Controllers | |
| Resolve Contention | |
| Queue Manager | |
| Anti-Surge Control | 2-1 |
| Compressor Turbine Overspeed Control | 2-2 |
| Compressor Turbine Overtemperature Control | 2-3 |
| Sense Feed Pressure | 3 |
| Monitor $\Delta T_C$ | 4-1 |
| Monitor $\Delta T_W$ | 4-2 |
| Fuel Balance Maintainance | 5 |
| Monitor Production | 6 |

TABLE 2-continued

| Routine Name | Priority |
|---|---|
| Monitor MakeUp Supply Pressures | 7 |
| Turn Down Production | 8-1 |
| Turn Up Production | 8-2 |
| Optimize | 8-3 |
| MR Liquid Level MakeUp Composition and Flow | 9-1 |
| Turn Up Fine | 9-2 |
| C Inject | 9-3 |

APPENDIX
Pseudocode Listing

SYSTEM EXECUTIVE

```
Initialize System
      Loop
      PAR:
            Monitor Operating Parameters
            Set Controllers
            Queue Manager
            Resolve Contention
            Monitor Production
            Anti-Surge Control
            Compressor Turbine Overspeed Control
            Compressor Turbine Overtemperature Control
            Sense Feed Pressure
            Monitor ΔTW
            Monitor ΔTC
            Monitor MakeUp Supply Pressures
            Fuel Balance
      EndLoop
GLabel: ABORT                                          {Global Label}
      SEQ:
            Take Controller Off-Line
            Accept Manual Control from Operator
      Loop
      PAR:
            Monitor Operating Parameters               {Give Human Some Help}
            Anti-Surge Control
            Compressor Turbine Overspeed Control
            Compressor Turbine Overtemperature Control
            Fuel Balance
      EndLoop.
```

Monitor Operating Parameters

```
Loop
      Get Value from Sensor                            {Scale or filter if necessary}
      Put Value in Corresponding Variable in Memory
EndLoop.
```

Set Controllers

```
Loop
      Get Control Value from Variable in Memory
      Set Corresponding Controller
EndLoop.
```

Resolve Contention

PseudoCode Listing

```
When Routine requests ACTIVE status
If Requestor Priority > Current Priority Then
      Begin
            Place Current Routine ID & Reassert Timer on Return Queue
```

```
                Zero Activity Status Flag of Current Routine
                Set Activity Status Flag of Requestor Routine
                Set Return Queue Flag
                Execute Requestor Routine
            End
        Else
            Begin
                Place Requestor Routine ID & Reassert Timer on Request Queue
                Set Request Queue Flag
            End
        Endif
```

Queue Manager

```
If Return Queue Flag is set Then
    For Each Routine ID in Queue
        If Reassert Timer = 0 Then
            Begin
                Dequeue Routine ID from Return Queue
                Request ACTIVE status for Routine ID
            End
        Else
            Decrement Reassert Timer
        Endif
Endif
If Request Queue Flag is set Then
    For Each Routine ID in Queue
        If Reassert Timer = 0 Then
            Request ACTIVE status for Routine ID
        Else
            Decrement Reassert Timer
        Endif
Else
Endif
```

PseudoCode Listing

Monitor Production {Main Routine}

```
Loop
    Get Target Production (P_T) from Operator
    Get Current LNG Production (P_M)
    If  P_M = P_T Then                                  {We're OK}
        Optimize
    Else
        If P_M > P_T Then
            Turn Down Production
        Else
            Turn Up Production
        Endif
    Endif
EndLoop.
```

Optimize

```
        Loop                                            {MR Level Control}
            Label:LevelStart
            Get Level HPSep
            If Level HPSep < HPSep_Min Then
                Begin
                    MR Liquid Level MakeUp Composition and Flow
                    Goto LevelStart
                End
```

```
        Else
            Loop
                Until Level HPSep ≤ HPSepMax
                Open MR Liquid Drain Valve 115
            EndLoop
            Close MR Liquid Drain Valve 115
        EndIf
EndLoop
Label:Optimize MR Composition
Optimize Flow Ratio Controller over Time against Efficiency {By Peak Hunt}
Optimize N2 Content of MR over Time against Efficiency      {By Peak Hunt}
Optimize C3:C2 Ratio over Time against Efficiency           {By Peak Hunt}
Label:Optimize CRC
Increment CRC by X% Until Efficiency Falls OR P_DM > P_Dmax  {Percentage is set
Decrement CRC by X% Until Efficiency Falls                    adaptively}
Get Turbine Speed (Sm_n)                                     {Optimize Speed}
If  Sm_n ≥ S_max Then
        Optimize Speed against Efficiency by Decreasing      {By Peak Hunt}
Else
        Optimize Speed against Efficiency by Increasing      {By Peak Hunt}
EndIf
```

PseudoCode Listing

```
Turn Down Production

If P_M < (P_T + 4%) Then
        Goto Turn Down Fine
EndIf
Label:Turn Down Gross
Get MR Compressor Suction Pressure (P_sc) and Store  as (P_sc_1)
If P_sc  ≤ (P_smin  + 4%) Then
        Monitor Production
Else
        Loop
                Get MR Compressor Suction Pressure (P_sc)
                Until P_sc ≤ (P_sc_1 - 4%) OR P_sc ≤ P_smin
                Open MR Compressor Suction Vent 151
        EndLoop
        Close MR Compressor Suction Vent 151
EndIf
Optimize
Goto Monitor Production
Label:Turn Down Fine
Get MR Compressor Suction Pressure (P_sc) and Store as (P_sc_1)
Get LNG Production P_M and Store as (P_M_1)
Loop
        Get MR Compressor Suction Pressure (P_sc)
        Until P_sc = (P_m_1 / (PT * (P_sc_1)))
        Open MR Compressor Suction Vent 151
EndLoop
Close MR Compressor Suction Vent 151
Optimize
```

PseudoCode Listing

```
Turn Up Production

If P_M > (P_T - 4%) Then
        Goto Turn Up Fine
EndIf
```

```
Label:Turn Up Gross
Loop
        Get ΔT_CE
        If ΔT_CE < ΔT_CEmin Then
                Open N2 Injection Valve 142a
                Wait X
                Close N2 Injection Valve 142a
                Wait Y
        Else
                Get MR Compressor Suction Pressure (P_sc) and Store as (P_sc_1)
                P_ST = (P_sc_1 + 4%)
                C Inject
        EndIf
EndLoop
Label:Turn Up Fine
Optimize
Get LNG Production P_M
If P_M > P_T Then
        Monitor Production
Else
        Get MR Compressor Suction Pressure (P_sc)
        P_ST = (P_T / (P_M * (P_sc_1)))
        C Inject
EndIf
```

PseudoCode Listing

MR Liquid Level MakeUp Composition and Flow

```
Store Initial MakeUp Inlet Valve Positions
Until MR Inventory = Target Inventory
Loop
        Get MR Composition (Mol%N2, Mol%C1, Mol%C2, Mol%C3)
        TLI := DL * IL / ( MWL * TE )                    {TLI is Inventory to MakeUp
                                                              DL is Norm. MR Liq. Density
                                                                    IL is Operating Invent.
                                                          MWL is Liq. Molec. Wt.
                                                          TE is Est. Time to MakeUp}
        Reset Timer
        Start Timer
        Loop
                Open N2 MakeUp Inlet Valve 142a to (Mol%N2) x TLI
                Open C1 MakeUp Inlet Valve 142b to (Mol%C1) x TLI
                Open C2 MakeUp Inlet Valve 142c to (Mol%C2) x TLI
                Open C3 MakeUp Inlet Valve 142d to (Mol%C3) x TLI
                Get MR MakeUp Flow
                TE := TE - Timer                         {New Estimate of Time.}
                TLI := DL * IL / ( MWL * TE )            {Recalc. Flow}
                If Makeup Flow < TLI Then                {Compare to Actual Flows}
                        TE := TE - X                     {Reduce TE to speed flows.}
                        TLI := DL * IL / ( MWL * TE )    {Recalc. Flow}
                        If MakeUp Rate / (TE-Timer) > MakeUp Flowmax Then
                                Set MakeUp Flow Alarm    {Oops, can't go that fast!
                                Goto ABORT                          So don't even try
                        EndIf
                EndIf
        EndLoop
        Restore Initial MakeUp Inlet Valve Positions
EndLoop.
```

Anti-Surge Control

```
Loop
      Get Flow at Compressor Outlet from Sensor
      Get Temperature at Compressor Outlet from Sensor
      Calculate Compensated Flow
      Calculate ds                                        {Distance to Surge}
      If ds < dsmin Then                                  {Min. allowed distance}
            Open Recycle Valve
      EndIf
EndLoop.
```

PseudoCode Listing

Function Efficiency (Time)

```
Begin
      Get Fuel Flow
      Get Fuel Heating Value (HV)
      Energy Consumption := Flow * Heating Value
      Get LNG Flow
      Efficiency := Energy Consumption / LNG Value        {Volume, heating value,etc.}
      Store Efficiency (Time)
End.
```

Compressor Turbine Overspeed Control

```
Loop
      Get Turbine Speed
      If Turbine Speed > SpeedMax Then
            Begin
                  Set Turbine OverSpeed Alarm
                  Reduce Speed to 105%
            End
      EndIf
EndLoop.
```

Compressor Turbine Overtemperature Control

```
Loop
      Get Turbine Firing Temperature
      If Turbine Firing Temperature > TempMax Then
            Begin
                  Set Turbine OverTemp Alarm
                  Reduce Fuel by Q%
            End
      EndIf
EndLoop.
```

PseudoCode Listing

C Inject

```
Open C1 Injection Valve 142b
LabelLoopTop
Get MR Compressor Discharge Pressure PDM
If PDM < PDmax Then
      Get ΔPW
      Get ΔPC
      If ΔPW < ΔPWmax AND ΔPC < ΔPCmax Then               {Prioity to Upset ΔP}
            Get Tt
```

```
            If Tt < Ttmax Then                                  {Priority to Turbine Temp.}
                  Get MR Compressor Suction Pressure (Psc)
                  If Psc ≥ PST Then
                        Close C1 Injection Valve 142b
                        Optimize
                  Else
                        Goto LoopTop
                  EndIf
            Else
      Else
Else
                  Close C1 Injection Valve 142b
                  If OPT = 1 Then
                        PT := PT - (PT - PM * 0.67)             {Reset Target}
                        OPT=0
                  Else
                        OPT=1
                        Optimize
                  EndIf
            EndIf
      EndIf
EndIf.
```

Sense Feed Pressure

```
Loop
      Get PFeed
      If PFeed < (75% of Nominal) Then
            Begin
                  Alarm Operator
                  Goto ABORT
            End
      EndIf
EndLoop.
```

PseudoCode Listing

Monitor $\Delta T_C$

```
Loop
      Get ΔTC
      Display ΔTC
      If ΔTC < ΔTCmm Then
            Begin
                  Alarm Operator
                  Goto ABORT
            End
      EndIf
Endloop.
```

Monitor $\Delta T_W$

```
Loop
      Get ΔTW
      Display ΔTW
      If ΔTW > ΔTWmax Then
            Begin
                  Alarm Operator
                  Goto ABORT
            End
      EndIf
EndLoop.
```

PseudoCode Listing

Monitor MakeUp Supply Pressures

```
Loop
      Get P(N2), P(C1), P(C2), P(C3)
      Get P(MR)
      Display P(N2), P(C1), P(C2), P(C3),P(MR)
      If (P(N2) - P(MR)) < Pmin Then
            Begin
                  Alarm Operator
                  Goto ABORT
            End
      EndIf
      If (P(C1) - P(MR)) < Pmin Then
            Begin
                  Alarm Operator
                  Goto ABORT
            End

      If (P(C2) - P(MR)) < Pmin Then
            Begin
                  Alarm Operator
                  Goto ABORT
            End
      EndIf
      If (P(C3) - P(MR)) < Pmin Then
            Begin
                  Alarm Operator
                  Goto ABORT
            End
      EndIf
EndLoop.
```

PseudoCode Listing

Fuel Balance

```
Loop
      Label:FuelBal
      Get Fuel Inlet Pressure (Pf)
      Vvp := ( (Pf - Pfmid) / (Pfmax - Pfmid) ) * 100
      Vfp := ( (Pfmid - Pf) / (Pfmid - Pfmin) ) * 100
      If Vvp > 0 Then
            Open Vent Valve 164 by Vvp%                          {Vent Fuel Header}
            Reset Temperature Controller 58 lower by X%          {Less Flash from 154}
            Wait for X minutes
            Goto FuelBal
      Else
            If Vfp > 0 Then
                  Open Fuel Feed MakeUp Valve 160 by X%          {Get More Fuel from Feed}
                  Reset Temperature Controller 58 higher by X%   {Make More Flash in 154}
                  Wait X minutes
                  Goto FuelBal
            EndIf
      EndIf
EndLoop.
```

Updated 4/17/86

I claim:

1. A method for efficiently operating a liquefied natural gas production facility comprising the steps of:

monitoring key variables representative of the state of operation of said facility;

determining a desired production rate for said facility;

comparing said desired production rate to the value of a key variable representative of the current production rate of said facility;

setting a plurality of controllers to change production to a rate equal to said desired rate; and controlling and optimizing mixed refrigerant composition and mixed refrigerant compression ratio as well as other plant operating variables with respect to overall efficiency by means of adjusting an operating parameter selected from the group consisting of:

(a) mixed refrigerant make up rate;
(b) mixed refrigerant venting;
(c) mixed refrigerant liquid draining;
(d) compressor turbine speed;
(e) relative mixed refrigerant liquid and vapor flows; and
(f) fuel header pressure.

2. A method for efficiently operating a liquefied natural gas production facility comprising the steps of:

monitoring key variables representative of the state of operation of said facility;

monitoring compressors for surge condition and opening a recycle valve to prevent surge;

determining a desired production rate for said facility;

comparing said desired production rate to the value of a key variable representative of the current production rate of said facility;

setting a plurality of controllers to increase or to decrease production to a rate equal to said desired rate; and optimizing operation by maintaining mixed refrigerant liquid inventory within a predetermined range, adjusting mixed refrigerant composition and mixed refrigerant compression ratio with respect to overall efficiency.

3. A method for efficiently operating a liquefied natural gas production facility comprising the steps of:

(a) determining a desired production rate;
(b) determining the current production rate;
(c) determining the cold-end temperature differential ( $I_{CE}$) ;
(d) comparing said desired production rate to said current production rate; and
(e) increasing production if said current production rate is below said desired production rate by:
  (i) if $T_{CE}$<a predetermined minimum then: injecting a predetermined amount of nitrogen into the mixed refrigerant inventory of said facility:
  (ii) if $T_{CE}$>said predetermined minimum then: injecting methane into the mixed refrigerant inventory of said facility until the mixed refrigerant compressor suction pressure rises by a predetermined amount;
  (iii) optimizing mixed refrigerant liquid inventory, mixed refrigerant composition with respect to overall efficiency; or
(f) decreasing production if said current production rate is above said desired production rate by:
  (i) decreasing mixing refrigerant compressor suction pressure;
  (ii) optimizing mixed refrigerant liquid inventory, mixed refrigerant compression ratio, and mixed refrigerant composition with respect to overall efficiency; or
(g) optimizing overall facility efficiency if said current production rate is equal to said desired production rate by maintaining mixed refrigerant liquid inventory within a predetermined range.

4. A method for efficiently operating a liquefied natural gas production facility comprising the steps of:

(a) determining a desired production rate;
(b) determining the current production rate;
(c) comparing said desired production rate to said current production rate;
(d) increasing production if aid current production rate is below said desired production rate by;
  (i) if $T_{CE}$<a predetermined minimum then: injecting a predetermined amount of nitrogen into the mixed refrigerant inventory of said facility;
  (ii) if $T_{CE}$>said predetermined minimum then: injecting methane into the mixed refrigerant inventory of said facility until the mixed refrigerant compressor suction pressure rises by a predetermined amount;
  (iii) optimizing mixed refrigerant liquid Inventory, mixed refrigerant compression ratio, and mixed refrigerant composition with respect to overall efficiency; and decreasing production if said current production rate is above said desired production rate by:
  (i) decreasing mixed refrigerant compressor suction pressure;
  (ii) optimizing mixed refrigerant liquid inventory, mixed refrigerant compression ratio, and mixed refrigerant composition with respect to overall efficiency; and optimizing overall facility efficiency if said current production rate is equal to said desired production rate by (ii) adjusting mixed refrigerant composition with reference to overall facility efficiency.

5. A method for efficiently operating a liquefied natural gas production facility comprising the steps of:

(a) determining a desired production rate;
(b) determining the current production rate;
(c) comparing said desired prodution rate to said current production rate;
(d) increasing production if said current production rate is below said desired production rate by:
  (i) if $T_{CE}$<a predetermined minimum then: injecting a predetermined amount of nitrogen into the mixed refrigerant inventory of said facility;
  (ii) if $T_{CE}$>said predetermined minimum then: injecting methane into the mixed refrigerant inventory of said facility until the mixed refrigerant compressor suction pressure rises by a predetermined amount;
  (iii) optimizing mixed refrigerant liquid inventory mixed refrigerant compression ratio, and mixed refrigerant composition with respect to overall efficiency; and decreasing production if said current production rate is above said desired production rate by:
  (i) decreasing mixed refrigerant compressor suction pressure;
  (ii) optimizing mixed refrigerant liquid inventory, mixed refrigerant compression ratio, and mixed refrigerant composition with respect to overall efficiency; and optimizing overall facility efficiency if said current production rate is equal to said desired production rate by (iii) adjusting refrigerant compression ratio with reference to overall facility efficiency.

6. A method for efficiently operating a liquefied natural gas production facility comprising the steps of:

(a) determining a desired production rate;

(b) determining the current production rate;

(c) comparing said desired production rate to said current production rate;

(d) increasing production if said current production rate is below said desired production rate by:

(i) if $T_{CE}$<a predetermined minimum then: injecting a predetermined amount of nitrogen into the mixed refrigerant inventory of said facility;

(ii) if $T_{CE}$>said predetermined minimum then: injecting methane into the mixed refrigerant inventory of said facility until the mixed refrigerant compressor suction pressure rises by a predetermined amount;

(iii) optimizing mixed refrigerant liquid inventory, mixed refrigerant compression ratio, and mixed refrigerant composition with respect to overall efficiency; and decreasing production if said current production rate is above said desired production rate by:

(i) decreasing mixed refrigerant compressor suction pressure;

(ii) optimizing mixed refrigerant liquid inventory, mixed refrigerant compression ratio, and mixed refrigerant composition with respect to overall efficiency; and optimizing overall facility efficiency if said current production rate is equal to said desired production rate by (iv) adjusting compressor turbine speeds with reference to overall facility efficiency.

7. A method for maximizing the output of a liquefied natural gas production facility comprising the steps of:

(a) setting the desired production rate to a predetermined value, said value being higher than the maximum attainable production rate of said facility;

(b) determining the current production rate;

(c) if said current production rate is below the maximum attainable production rate, then increasing production to said maximum attainable level by repeatedly performing the steps of:

(i) determining the cold-end temperature differential ($\Delta T_{CE}$);

(ii) comparing said determined $\Delta T_{CE}$ to a predetermined minimum value;

(iii) if said $\Delta T_{CE}$ is less than said minimum value, then injecting a predetermined amount of nitrogen into mixed refrigerant inventory of said facility, waiting a predetermined period of time;

(iv) if said $\Delta T_{CE}$ is greater than or equal to said minimum value, then:

injecting methane into the mixed refrigerant inventory of said facility, until an operational parameter design limit is exceeded, or until a predetermined mixed refrigerant compressor suction pressure is reached.

8. The method of claim 7 further including the steps of:

halting said methane injection, and if an optimization indicator is not met, then:

optimizing overall facility efficiency and setting said optimization indicator, and if said optimization indicator is met, then:

reducing said desired production rate by a predetermined fraction of the difference between said desired production rate and said current production rate.

9. The method of claim 2 or 3 or 4 or 5 wherein decreasing production includes performing the steps of:

(a) decreasing mixed refrigerant compressor suction pressure;

(b) optimizing mixed refrigerant liquid inventory, mixed refrigerant compression ratio, and mixed refrigerant composition with respect to overall efficiency.

10. The method of claim 2 or 3 or 4 or 5 wherein increasing production includes performing the steps of:

(a) if $\Delta T_{CE}$<a predetermined minimum then:

injecting a predetermined amount of nitrogen into the mixed refrigerant inventory of said facility;

(b) if $\Delta T_{CE}$>said predetermined minimum then:

injecting methane into the mixed refrigerant inventory of said facility until the mixed refrigerant compressor suction pressure rises by a predetermined amount;

(c) optimizing mixed refrigerant liquid inventory, mixed refrigerant compression ratio, and mixed refrigerant composition with respect to overall efficiency.

11. The method of claim 2 wherein maintaining mixed refrigerant liquid inventory within a predetermined range includes performing the steps of:

(a) measuring the level of mixed refrigerant in the high pressure liquid separator vessel;

(b) if said level is above a predetermined maximum level then draining said liquid in until said level falls below said level;

(c) if said level is below a predetermined minimum level then adding each component of said liquid in proportions identical to the composition of said liquid until said level rises above said minimum level.

12. The method of claim 2 wherein adjustments of said mixed refrigerant composition includes performing the steps of:

(a) adjusting the Flow Ratio Controller to obtain maximum efficiency;

(b) adjusting the nitrogen content of said mixed refrigerant to obtain maximum efficiency;

(c) adjusting the $C_3$:$C_2$ ratio of said mixed refrigerant to obtain maximum efficiency.

13. The method of claim 2 or 3 or 4 or 5 wherein overall facility efficiency is calculated as the energy required to produce a predetermined value amount of product.

14. The method of claim 2 or 3 or 4 or 5 further including anti-surge control of said mixed refrigerant compressors.

15. The method of claim 2 or 3 or 4 or 5 further including maintaining fuel header pressure at a midpoint between predetermined minimum and maximum values by performing the steps of:

(a) venting to reduce and resetting a temperature controller lower to reduce flash from a product flash vessel; or (b) making up from natural gas feed and resetting said temperature controller higher to increase flash from said product flash vessel.

16. The method of claim 2 or 3 or 4 or 5 further including preventing overspeed conditions in the turbines powering said mixed refrigerant compressors.

17. The method of claim 2 or 3 or 4 or 5 further including preventing overtemperature conditions in the turbines powering said mixed refrigerant compressors.

18. The method of claim 2 or 3 or 4 or 5 further including preventing or alerting an operator to out-of-design conditions related to upset pressure differentials ($\Delta,\Delta$), feed pressure, or makeup pressure.

* * * * *